US005580096A

United States Patent [19]

Freilich

[11] Patent Number: 5,580,096

[45] Date of Patent: Dec. 3, 1996

[54] ENDLESS BELT ROLLER SKATE

[76] Inventor: Daniel S. Freilich, 30328 Olympic St., Castaic, Calif. 91384

[21] Appl. No.: 482,865

[22] Filed: Jun. 7, 1995

Related U.S. Application Data

[63] Continuation-in-part of Ser. No. 68,239, filed as PCT/US94/05939, May 26, 1994.

[51] Int. Cl.[6] ..... A63C 17/10

[52] U.S. Cl. ..... 280/844

[58] Field of Search ..... 280/844, 11.19, 280/11.22, 11.27, 11.28; 305/39, 40, 41, 47

[56] References Cited

U.S. PATENT DOCUMENTS 489,946 6/1908 Miller ..... 280/844
1,868,148 7/1932 McMillan et al. .

FOREIGN PATENT DOCUMENTS 135274 11/1949 Australia ..... 280/844

*Primary Examiner*—Richard M. Camby
*Attorney, Agent, or Firm*—Freilich, Hornbaker & Rosen

[57] ABSTRACT

A skate roller assembly, incorporating an endless belt, configured to support a user's weight and present a substantially continuous arcuate bearing surface to a supporting ground surface. The roller assembly is intended for attachment to a boot foot plate and is characterized by an elongate endless belt comprised of a plurality of elements hinged relative to one another to enable the elements to move around a closed loop including a longitudinally oriented lower loop portion. The belt, in the region coincident with said lower loop portion, forms a rocker for supporting a user's weight and presenting a substantially continuous arcuate bearing surface to a supporting ground surface. The rocker is formed by a group of successive belt elements, or arc segments, which, when in the lower loop portion, engage to form an arc defining said arcuate bearing surface. A user's weight is loaded onto the rocker via one or more lead transfer members, e.g., idler wheels which engage the belt inner arcuate surface.

8 Claims, 12 Drawing Sheets

FIG.23
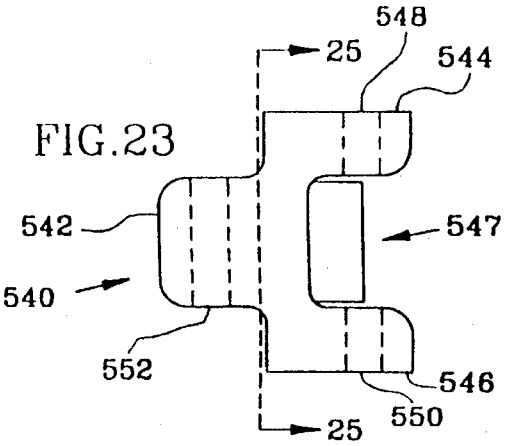
FIG.24
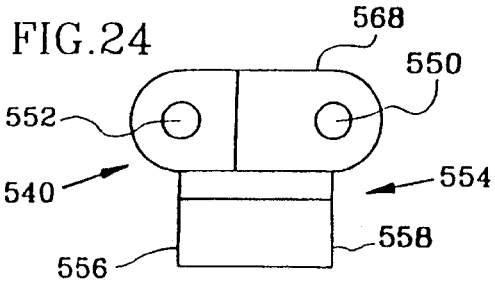
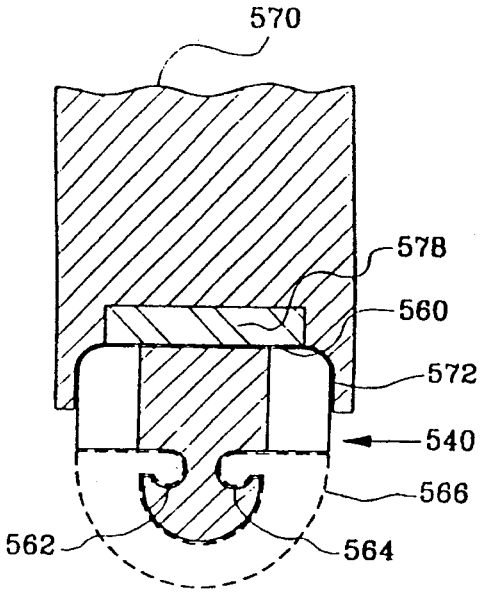
FIG.25
FIG.26
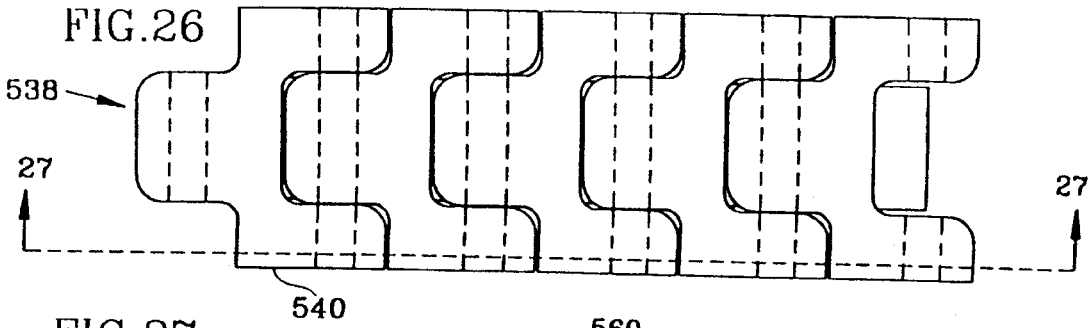
FIG.27
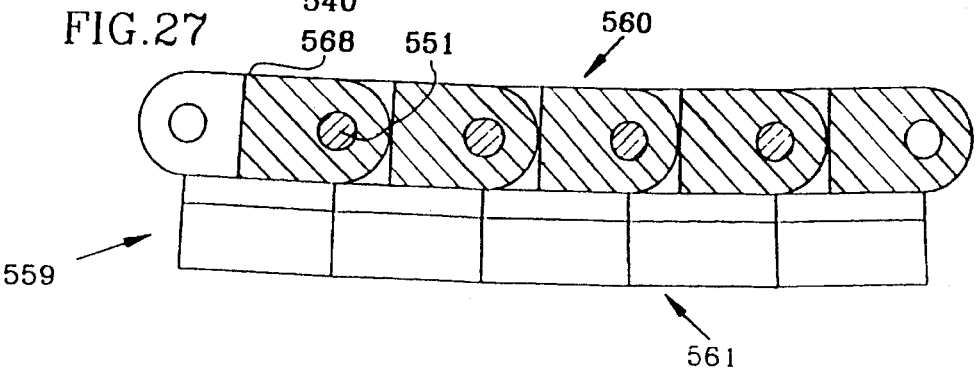

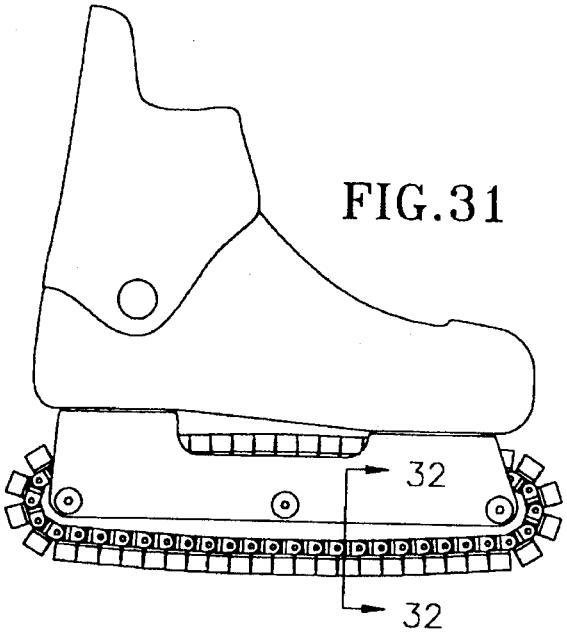
FIG.31
FIG.32
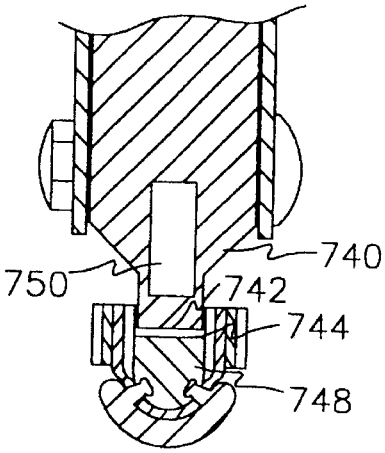
FIG.33A
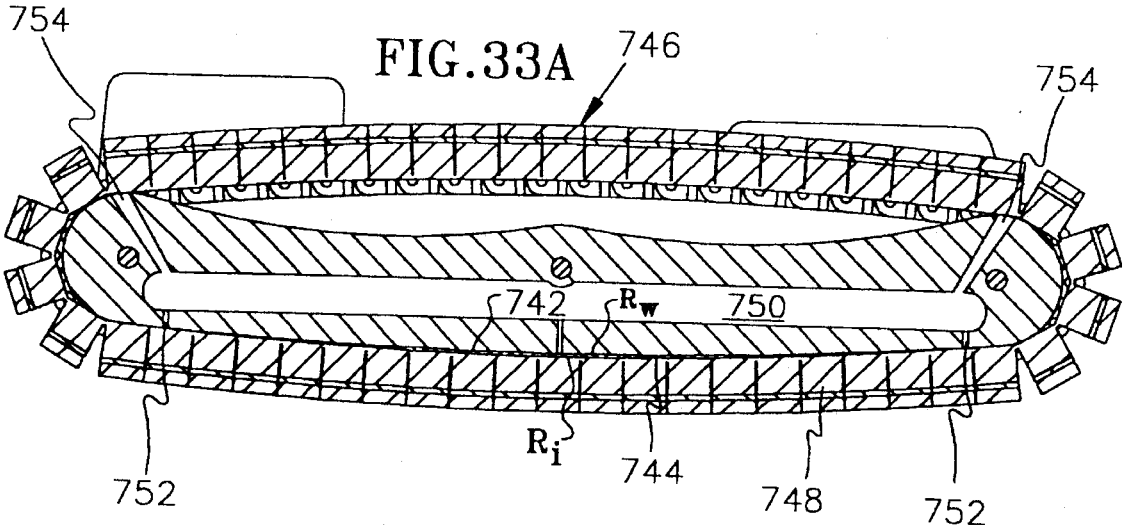
FIG.33B
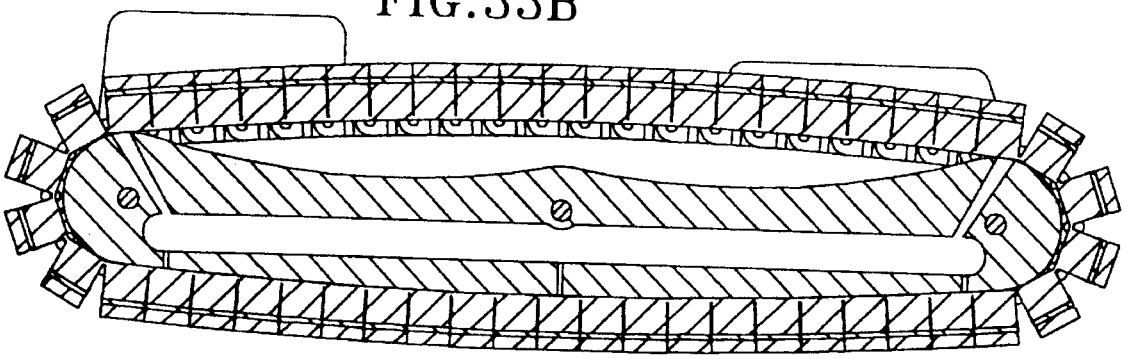

ENDLESS BELT ROLLER SKATE

RELATED APPLICATIONS

This is a continuation-in-part of U.S. patent application Ser. No. 08/068,239, pending, filed May 27, 1993 and also claims priority based on International Application PCT/US94/05939 filed 26 May 1994.

FIELD OF THE INVENTION

This invention relates generally to roller skates and more particularly to a skate undercarriage assembly including an endless belt configured to provide a weight supporting portion having an outer arcuate surface for bearing against and rolling along a supporting ground surface.

BACKGROUND OF THE INVENTION

The prior art is recplete with various roller assembly constructions intended for mounting under a boot foot plate to form a roller skate. Conventionally, such roller skates utilize a pair of laterally aligned front wheels and a separate pair of laterally aligned rear wheels.

In recent years, in-line roller skates have become extremely popular. Such skates generally use three to five identical wheels supported in alignment. Typically, such wheels have about a 2.75 inch (70 mm) diameter with the respective laterally oriented wheel axles being longitudinally spaced by about 3 inches. The axles are typically aligned about 2 inches beneath the foot plate so that a flat ground surface is tangent to all of the wheels. However, many models of in-line skates include a "rocker capability" enabling a user to lower the position of the center wheels, relative to the front and rear wheels. For example only, sec U.S. Pat. Nos. 5,048,848 and 3,880,441.

In-line skate wheel rocketing is intended to simulate the arcuate bearing surface provided by an ice hockey skate rocker blade to improve maneuverability. However, whereas a rocker blade presents a continuous arcuate bearing surface, wheel rockering can only roughly simulate this continuous surface since it is essentially defined by straight line segments between discrete wheel contact points. More particularly, when the wheels are in the rocker position, the user's weight will usually be supported on the two center wheels, but in the course of skating, will typically move to (1) the front and front center wheels or to (2) the rear and rear center wheels. In going through such transitions, the user's weight for short intervals will be supported on only a single wheel. This therefore requires that each wheel and its associated axle and bearing structure be designed to readily support the full weight of the user to avoid introducing excessive frictional drag. Moreover, when in the rocker position, the user's foot plate is supported only on the short span between adjacent wheels, thus reducing skater stability in favor of enhanced maneuverability. However, wheel rockering still docs not yield the full maneuverability advantages offered by the continuous curve of a rocker blade since it merely simulates an are by spaced discrete wheel contact points.

In addition to the aforementioned conventional and in-line skates, endless tread skates have also been known for many years. Exemplary U.S. patents include U.S. Pat. Nos. 342,458; 675,824; 889,946; 1,694,162; 2,412,290; 3,671,051; 4,572,528; 4,627,630. Exemplary foreign patents include UK Patent 422,633 and Australian patent 135,274. These endless tread skates utilize a flexible belt or chain which travels around and conforms to a defined path, typically formed by a plurality of wheels or rollers, to essentially lay down a smooth track for the rollers. Although the path defined by the rollers can be arcuately shaped, nevertheless since the flexible belt conforms to the path, and is not designed to be weight supporting, a user's weight will still be supported on only one or two rollers. Thus, the stability and maneuverability characteristics of such endless tread skates would be similar to wheel rockered in-line skates.

SUMMARY OF THE INVENTION

The present invention is directed to a skate undercarriage roller assembly incorporating an endless belt (which term should be understood to include various elongate flexible closed loop structures such as integral webs and interconnected links) configured to support a user's weight and present an elongate outer arcuate surface for bearing against and rolling along a supporting ground surface.

A roller assembly in accordance with the invention is intended for mounting under a boot foot plate and is characterized by an elongate endless belt comprised of a plurality of elements hinged relative to one another to enable the elements to move around a closed loop including a longitudinally oriented lower loop portion. In accordance with the invention, a user's weight is transferred to the belt which, in the region coincident with said lower loop portion, forms a self-sustaining, rigid rocker, i.e., an elongate arcuate member capable of supporting a user's weight and having an outer arcuate surface for bearing against a supporting ground surface. The rocker is formed by a group of successive belt elements, which, when in the lower loop portion, engage to form said outer arcuate bearing surface. The arcuate bearing surface is characterized by a large, but finite, radius of curvature to facilitate skate maneuverability and smooth rolling over ground surface discontinuities.

In accordance with a preferred embodiment, the rocker inner surface defines a self-sustaining are having a nominal radius of curvature equal to $R_i$ which is loaded by one or more lead transfer members which collectively define a radius of curvature equal to $R_w$, where $R_w$ is greater than $R_i$. As a consequence, the load transfer members engage the belt inner surface and distribute the user's weight over the length of the rocker acting to rigidify the rocker.

In an exemplary embodiment, the rocker places a relatively short (e.g., between 0.5 and 3.5 inches) substantially continuous portion of the arcuate bearing surface in contact with the ground surface, thus allowing the skates to be readily and quickly pivoted, making them particularly suitable for roller hockey use. Additionally, however, user comfort, stability, and safety are enhanced as a consequence of (1) the foot plate being supported over substantially its entire length by the formed rigid rocker and (2) the large radius of curvature (e.g., approximately 56 inches) of the bearing surface which enables it to readily roll over ground surface discontinuities, such as pavement cracks, patterned surfaces, e.g., cobblestones, or miscellaneous obstructions, e.g., a hose. Thus, embodiments of the invention can be advantageously used for a wide variety of roller skating activities.

In accordance with a preferred embodiment, the roller assembly is configured so that a user's weight is transferred, via the foot plate and one or more lead transfer members to the bell's inner surface to lead the rocker. More particularly, the belt elements are connected to one another for hinged movement about successive longitudinally spaced hinged axes. Adjacent elements have interference surfaces which engage each other to limit the range of motion around a hinge axis to cause the elements of the lower loop portion to form said rocker. When a user's weight is loaded onto said belt inner surface spanning a group of successive elements forming the rocker, portions of the spanned elements are forced into engagement enabling the user's weight to be supported above the bell's outer arcuate surface which bears against and rolls along the supporting ground surface.

A preferred embodiment of the invention includes a frame and wheel subassembly including lead transfer members in the form of two spaced end idler wheels and one or more intermediate idler wheels having a diameter greater than that of the end idler wheels. The axles of the idler wheels are mounted in substantial alignment beneath a boot foot plate so that the wheels proximate to said lower loop portion describe a concave are tangential to the wheels. The idler wheels engage the belt inner surface so that weight applied to the foot plate is transferred via the idler wheels to lead the belt elements spanned by the idler wheels. The rocker inner surface defines a self-sustaining are having a nominal radius of curvature equal to $R_i$ and the plurality of idler wheels collectively define a radius of curvature equal to $R_w$, where $R_w$ is large and finite and slightly greater than $R_i$. As a consequence, the idler wheels engage the belt inner surface, distributing the user's weight across the plurality of idler wheels and loading the belt to rigidify said rocker.

An endless belt in accordance with the invention can take many different forms. For example, it can be formed of a plurality of separate identical links successively interconnected by laterally oriented longitudinally spaced hinge pins (e.g., FIGS. 6–11). Alternatively, (e.g., FIGS. 13–15), successive links can be hinged to interconnecting side straps, as is typical of conventional roller or sprocket chains. Further, the belt can be integrally formed (e.g., FIGS. 16–19) in a manner typically used to fabricate commercially available plastic timing belts. Moreover, each such belt type, as well as others, can be fabricated using various well known techniques and materials. As an example, an individual link can be formed of steel, or aluminum, or other appropriate metal, or alternatively of a suitable plastic or composite, depending upon the intended user and skate application, ranging for example, from a low weight novice to a high weight aggressive hockey player. Links can be formed by any of several well known practices such as machining, casting, stamping, molding, etc.

In a first preferred embodiment, (FIGS. 6–11 ), the belt elements comprise longitudinally aligned links which hinge about axes defined by laterally oriented hinge pins, retained proximate to the belt inner surface. Successive hinge axes are longitudinally spaced by a dimension X proximate to the aforementioned belt inner surface. Each link comprises a wedge-like are segment defining longitudinally spaced interference surfaces outwardly of said belt inner surface for establishing a minimum element-to-element dimension thereat equal to Y, where Y>X, to thus force the links into the aforementioned self-sustaining rocker. Each link carries a tire piece which forms part of the ground engaging arcuate bearing surface. The links and tire pieces can be separately or integrally formed and can be permanently or detachably attached. Moreover, the tire pieces, rather than the links, can be configured to define said dimension Y.

Embodiments of the invention are preferably configured with a mating channel defined between the belt and idler wheels for facilitating low friction longitudinal belt movement. The channel can be formed in the belt itself to accommodate peripheral portions of the idler wheels. Alternatively, the idler wheels can be configured with a peripheral channel for accommodating the belt. With either construction, it is preferable to provide a central peripheral portion of the wheels with a somewhat softer compliant material for contacting the belt to facilitate smooth transition of the belt around the wheels.

In accordance with a further feature, each belt element can optionally include an adjustment member for selectively varying the longitudinal spacing between the interference surfaces thereof. This enables a user to establish a particular rocker are to achieve a desired "feel".

In accordance with alternative preferred embodiments, one or more of the load transfer members can comprise a rigid member having a low friction surface which bears against the belt inner surface which slides relative thereto. A single rigid member low friction surface can fully define the loading surface $R_w$ or can cooperate with other rigid members or one or more idler wheels to form the loading surface $R_w$. Depending upon the application (e.g., user weight and skill level), it is sometimes desirable to dispense lubricant into the interface between the low friction surface and the belt inner surface to facilitate sliding.

DESCRIPTION OF THE FIGURES

FIGS. 23 and 24 respectively show plan and side elevations a single-Y shaped belt link;

FIG. 25 is a sectional taken substantially along the plane 25—25 of FIG. 23 showing the link in relation to an idler wheel and depicting a tire piece in phantom mounted on the link;

FIG. 26 shows a plan view of a series of links of the type shown in FIG. 23 connected together to form a belt; and FIG. 27 is sectional view taken substantially along the plane 27—27 of FIG. 26.

FIG. 31 is a side plan view of a further alternative embodiment of the invention using idler wheels and low friction slide surfaces cooperatively to load the belt rocker;

FIG. 32 is a sectional view taken substantially along the plane 32—32 of FIG. 31; and FIGS. 33A and 33B comprise longitudinal sectional views respectively depicting the belt of FIG. 28 in unloaded and loaded conditions.

DETAILED DESCRIPTION

Figure 2:
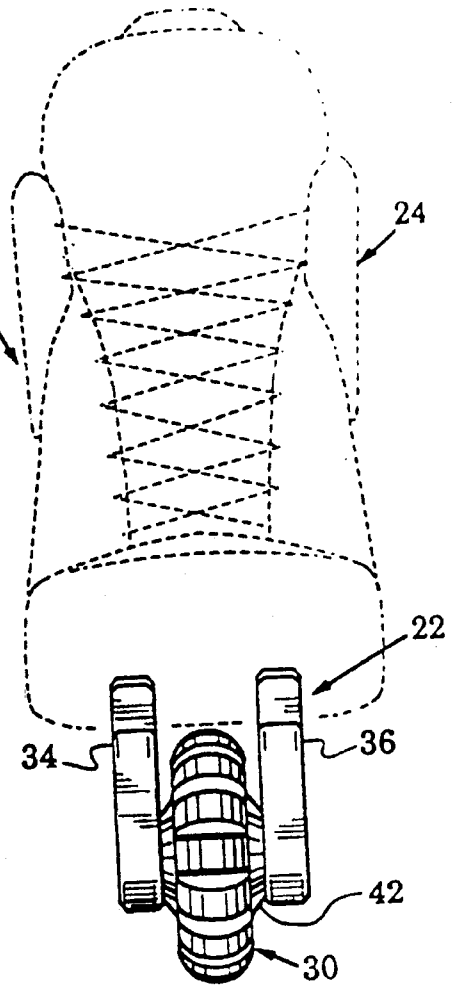
FIG. 2 is an end plan view of the roller skate of FIG. 1.
Figure 1:
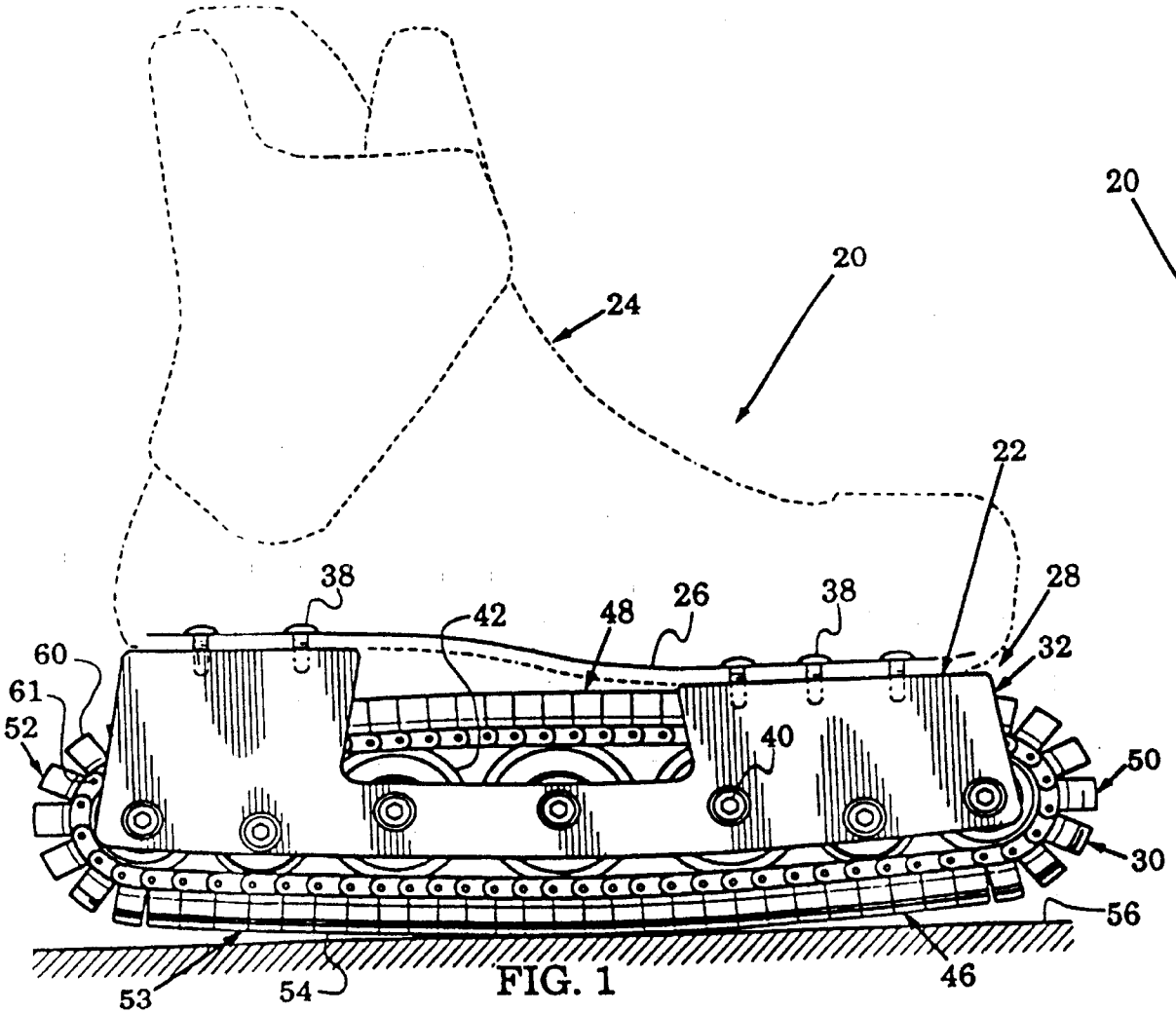
FIG. 1 is a side plan view of a roller skate including a roller assembly in accordance with the present invention.
Figure 3A:
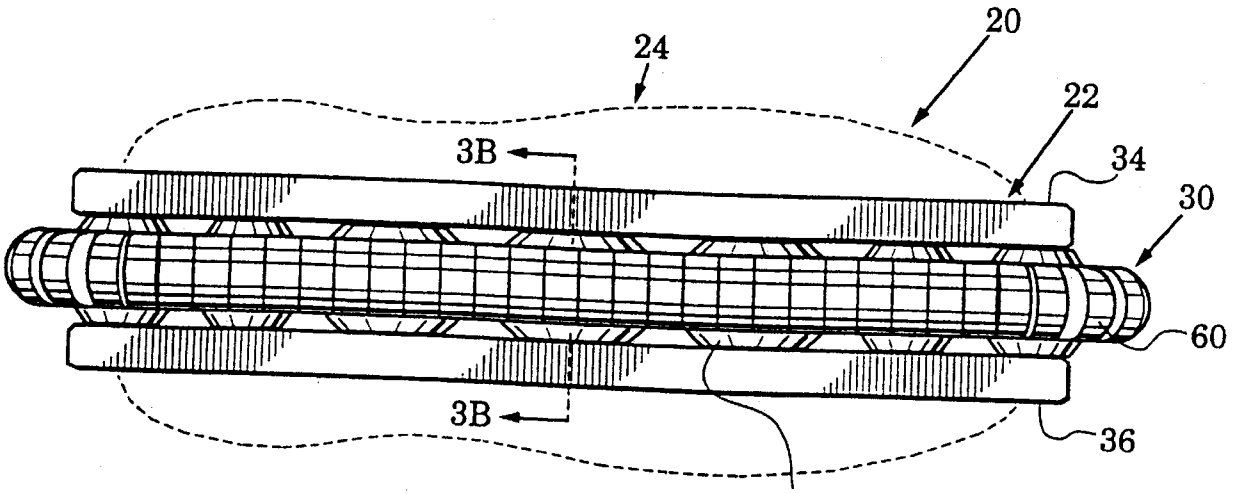
FIG. 3A is a bottom plan view of the roller skate of FIG. 1.

Attention is initially directed to FIGS. 1–3 which illustrate a preferred embodiment of an endless belt roller skate 20 in accordance with the present invention. The skate 20 generally comprises a roller assembly 22 attached to a conventional boot 24, preferably having a rigid foot plate 26.

The roller assembly 22 is comprised generally of a frame and wheel subassembly 28 and an elongate belt 30 configured as an endless loop (the term "belt" as used herein is intended to include various elongate flexible closed loop structures such as integral webs (e.g., FIG. 16) and interconnected links (e.g., FIGS. 10 and 13)). The subassembly 28 is comprised of a rigid frame 32 including first and second elongate frame members 34, 36. The frame members 34, 36 are rigidly attached to the foot plate 26 in spaced parallel relationship, as shown in FIGS. 2 and 3, by conventional fasteners 38. A plurality of axles 40 are mounted between the frame members 34, 36, each carrying an idler wheel 42. The endless loop belt 30 extends around the plurality of idler wheels 42 which collectively define a belt path and, in use, function to transfer a user's weight from the foot plate 26 to the belt 30. As will be explained in detail hereinafter, the endless loop belt 30 is configured to form a rigid rocker, i.e., an elongate arcuate member capable of supporting a user's weight and having an outer arcuate surface for bearing against a ground surface.

More particularly, note in FIG. 1 that the belt 30 forms an endless loop which essentially includes a longitudinally extending lower loop portion 46, a longitudinally extending upper loop portion 48, a toe end portion 50, and a heel end portion 52. The belt in the lower loop portion 46 forms a rocker 53 having a substantially continuous outer arcuate bearing surface 54 positioned to engage a ground surface 56. As will be discussed hereinafter, the outer arcuate bearing surface 54 has a large, but finite, radius of curvature, e.g., between one and ten feet. Stated differently, the belt 30 is constructed so that, when loaded by a user's weight, the bearing surface 54 conforms to the circumference of an imaginary or "virtual" wheel having a large radius, e.g., between one and ten feet. This large radius enables the bearing surface 54 to readily roll over obstructions on, or discontinuities in, the ground surface 56. Moreover, the relatively short but substantially continuous portion (e.g., between 0.5 and 3.5 inches) of the bearing surface engaged with the ground surface 56 enables a user to readily and quickly pivot the skate to achieve high maneuverability.

The constructional details of various belt implementations will be discussed hereinafter. Suffice it at this point to understand that the belt 30 is comprised of a plurality of longitudinally aligned elements 60 arranged in series, with adjacent elements being hinged relative to one another about hinge axes 61 to enable the elements to both form said aforementioned rocker and move around a closed loop path.

Figure 4A:
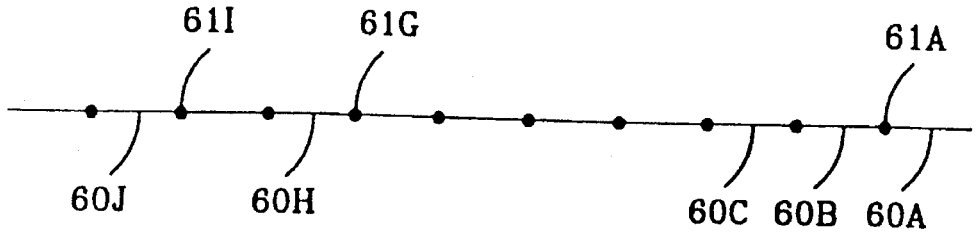
FIG. 4A schematically represents a belt comprised of a series of interconnected elements.
Figure 4B:
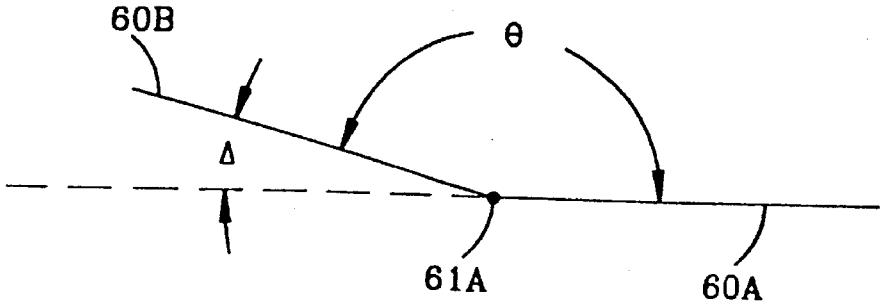
FIG. 4B schematically shows a pair of hinged belt elements.

In order to form the aforementioned rocker, at least some contiguous elements are constructed so that the interior hinge angle therebetween is limited to less than 180°. Consider FIG. 4A which schematically depicts a belt formed of elements 60A–60J interconnected for hinged movement about hinge axes 61A–61I. In accordance with the invention, the interior hinge angle θ (FIG. 4B) between contiguous elements, e.g., 60A and 60B, is limited to less than 180° and the exterior hinge angle Δ is, at a minimum, greater than 0°. As an example, consider a virtual wheel having a radius of 56 inches and a circumference of approximately 352 inches. If we assume that the rocker formed by the belt is,. approximately 10 inches in length, then it will describe an arc of approximately 10°

$$\left(\text{i.e., } \frac{10 \text{ inches}}{352 \text{ inches}} * 360^\circ\right).$$

If the elements are assumed to be identical and each element is approximately 0.5 inch in length, then each of the twenty elements in the rocker is misaligned by about 0.5 degree from its neighbor $$\left(\text{i.e., } \Delta = \frac{10^\circ}{20} = 0.5^\circ\right).$$

Figure 4C:
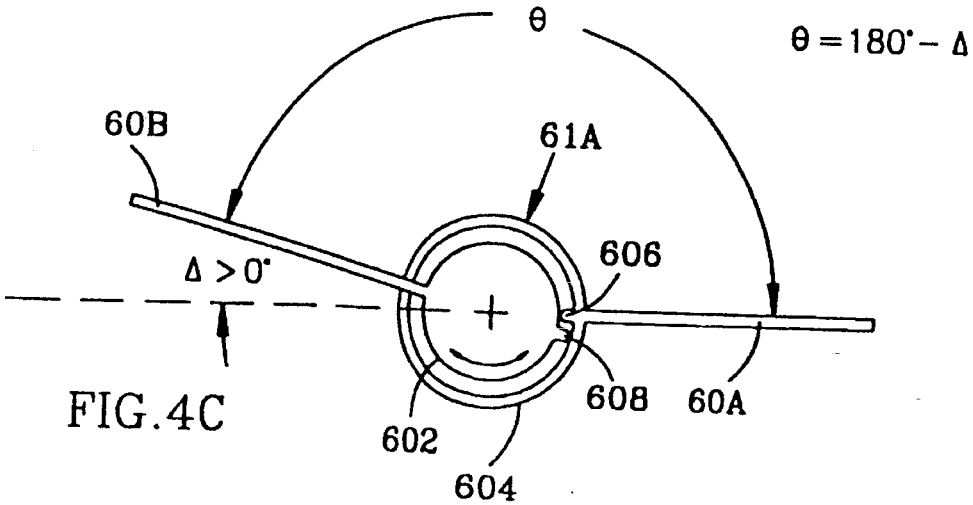
FIG. 4C schematically shows a hinge for limiting the range of hinge movement between adjacent elements to form a rocker.

FIG. 4C schematically depicts a hinge 61A for limiting the range of hinged movement between elements 60A and 60B.

Figure 4D:
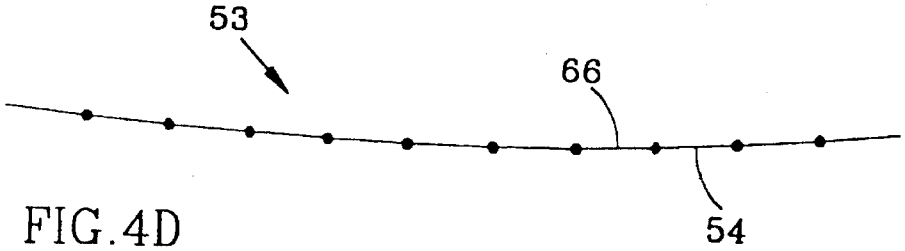
FIG. 4D schematically represents a plurality of hinged elements forming a rocker defining a concave inner surface and a convex outer surface.

The hinge is shown as being comprised of hinge pin 602, fixed to element 60B, mounted for rotation in bearing 604, fixed to element 60A. FIG. 4C also schematically shows a stop 606 projecting radially inwardly from element 60A and an interfering stem 608 projecting radially outwardly from element 60B. Note that the stop 606 is positioned so as to interfere with stem 608 and limit the counterclockwise (as viewed in FIG. 4C) range of hinged motion of element 60B relative to element 60A when the elements are loaded from above by a downward force component. This interference is designed to assure that the maximum interior hinge angle θ is less than 180°,i.e., θ=(180°-Δ) where Δ>0°, e.g., 0.5° . By hinging together a succession of elements 60, including at least some elements whose interior hinge angle is limited to less than 180°, a rocker 53 is formed, as represented in FIG. 4D, having a convex outer surface 54 and a concave inner surface 66.

Figure 3B:
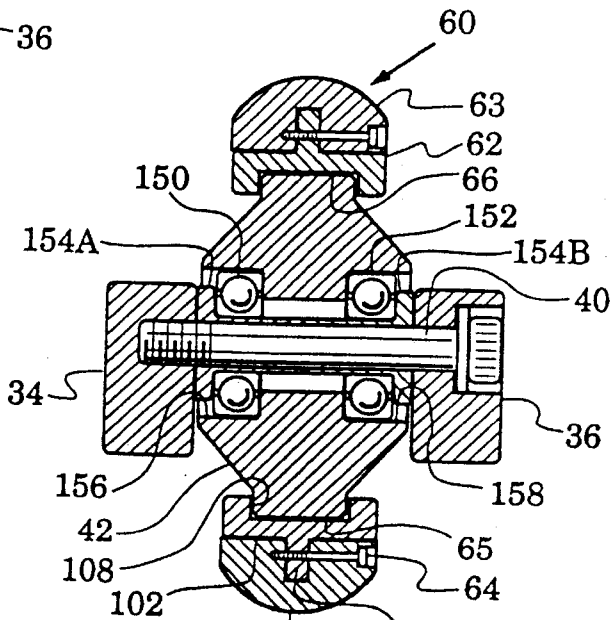
FIG. 3B is a sectional view (rotated by 90°) taken substantially along the plane 3B—3B of FIG. 3A.

In the embodiment depicted in FIG. 1–3, each belt element 60 is comprised of a link 62 and a tire piece 63 removably secured thereto by an appropriate fastener, e.g., screw 64 (FIG. 3B). Each of the links 62 defines a wheel channel having a flat floor surface 65, with the surfaces 65 collectively forming a belt inner surface 66 which is contacted by the wheels 42. Each tire piece 63 defines an outer surface 68, with the surfaces 68 collectively forming said belt outer bearing surface 54 for engaging the ground surface 56. Each link 62 is connected to adjacent leading and trailing links for hinged movement about a laterally directed hinge axis 61 (FIG. 1). As will be seen hereinafter, the belt 30 is constructed so that at least some elements 60 are restricted in their range of hinged motion (i.e., θ<180°) relative to an adjacent element 60, so as to thereby prevent said belt in the region of said lower loop portion 46, from straightening beyond the arcuate shape of said rocker 53. Whereas the mechanism schematically shown in FIG. 4C for limiting hinged motion utilizes a radially extending stop and stem for interfering with one another the preferred belt (FIGS. 5A–5D) utilizes wedge shaped elements 60 which have a dimension Y proximate to its outer surface slightly larger than a distance X between hinge axes proximate to its inner surface.

Figure 5A:
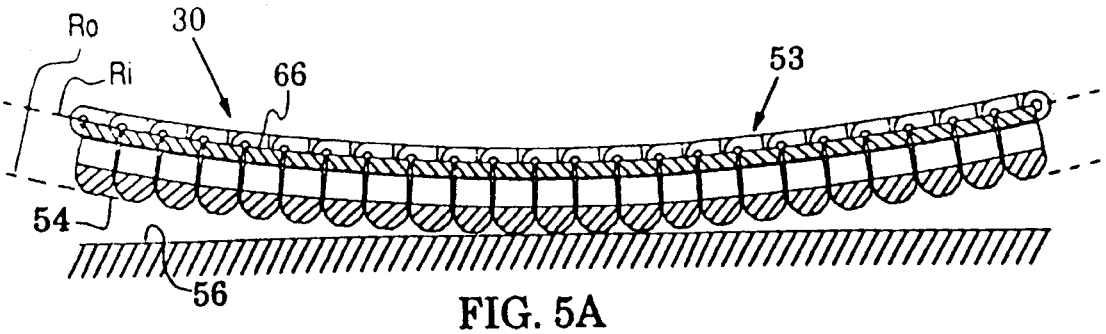
FIG. 5A schematically represents a belt constructed in accordance with the invention showing its self sustaining arcuate form.

In order to understand the operation of the roller assembly 22, attention is directed to FIG. 5A which schematically depicts a portion of a preferred belt 30 in its unloaded condition sitting on a horizontal ground surface 56 and forming a rocker. In a successful prototype embodiment, the belt inner surface 66 defines an arc having a nominal radius of curvature $R_i$, equal to approximately 56 inches, with the outer bearing surface 54, having a nominal radius of curvature $R_o$ equal to approximately 56.5 inches. As will be seen, the self sustaining rocker 53 shown in FIG. 5A, is able to support a user's weight distributed over the belt elements forming the rocker, i.e., the elements spanned by the idler wheels, to be discussed hereinafter. In the preferred belt 30, each belt element forms an arc segment so that its longitudinal dimension Y (FIG. 7) proximate to its outer surface 68 exceeds its longitudinal dimension X between hinge axes proximate to its inner surface 65. This forces the belt to define the rocker 53 represented in FIG. 5A having a concave inner surface 66 and convex outer surface 54. The amount or rate of curvature of the rocker is determined by the difference between dimensions Y and X.

Figure 5B:
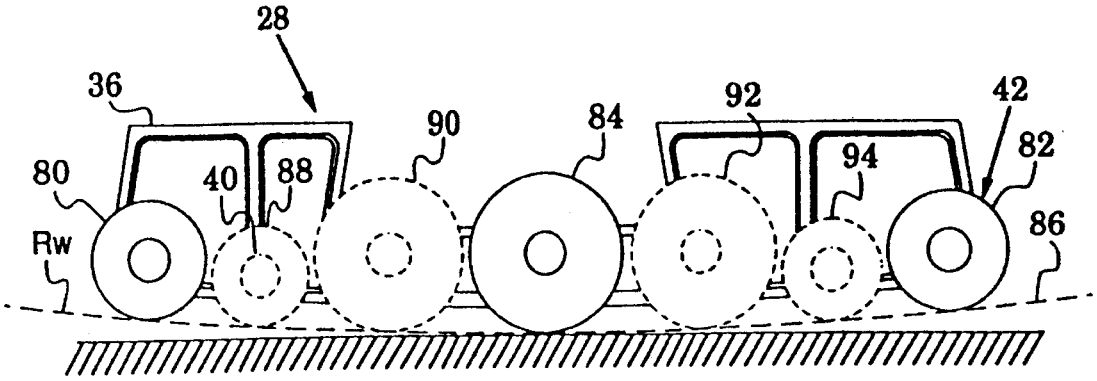
FIG. 5B schematically represents a frame and wheel subassembly in accordance with the invention.

FIG. 5B schematically depicts a frame and wheel subassembly 28 which is configured to substantially uniformly distribute the user's weight over the length of the rocker 53 by a plurality of load transfer members, preferably idler wheels 42. The plurality of idler wheels 42 preferably includes first and second end wheels 80 and 82 and at least one center wheel 84. The wheels 80,82,84 are supported for rotation about their respective axles 40 which are preferably aligned along a substantially horizontal plane as shown in FIG. 5B. The center wheel 84 has a larger diameter than end wheels 80, 82 so that they collectively define a loading surface comprising an arc 86 having a radius of curvature $R_w$. Alternatively, the arc 86 could be formed by vertically adjusting the position of the center wheel axle relative to the axles of end wheels 80, 82. However, the wheel geometry depicted in FIG. 5B is preferred because it provides support for the belt 30 along the upper loop portion 48, facilitating its movement around the idler wheels 42. The radius of curvature $R_w$ formed by the load transfer idler wheels 42 is preferably large and finite and slightly greater than the radius of curvature $R_i$ formed by the belt inner surface 66 (e.g., $R_i$=56 inches and R=56.3 inches) to assure proper belt loading.

In addition to the end wheels 80, 82 and center wheel 84, the subassembly 28 may also include additional intermediate idler wheels 88, 90, 92, 94 (shown in dashed line) having circumferential surfaces tangent to aforementioned are 86 to more uniformly distribute the user's weight along the rocker 53. The axles of wheels 90, 92 are shown aligned with the axles of wheels 80, 82, 84. Alternatively, in less demanding applications, one or more of the wheels could be replaced by a non-rotatable load transfer member, such as a suitably shaped block defining a low friction loading surface; e.g., see FIGS. 28–33.

Figure 5C:
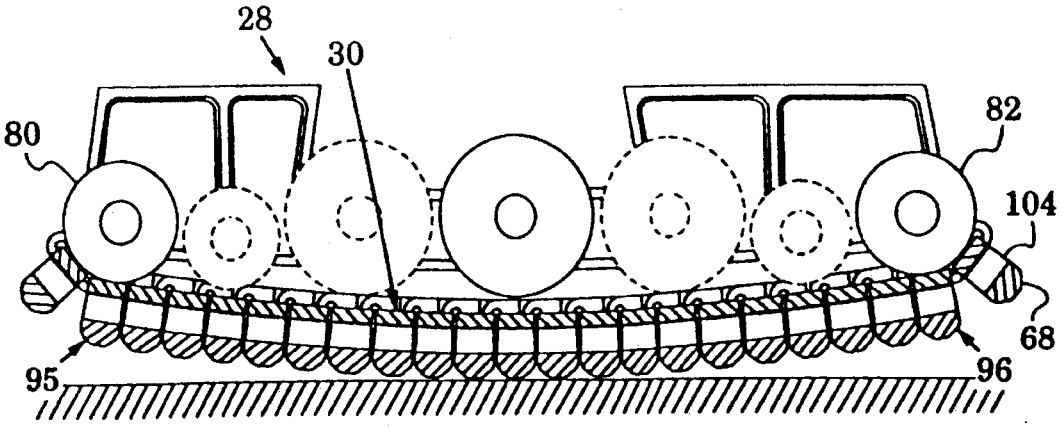
FIG. 5C shows the wheel and frame subassembly together with the belt in an unloaded state.

FIG. 5C schematically depicts the relative positioning between the belt 30 and the frame and wheel subassembly 28 when the skate is not being loaded by the user's weight. In this position, only the end wheels 80, 82 contact the belt inner surface 66 with the other wheels being slightly spaced therefrom attributable to the small difference between $R_w$ and $R_i$. The end wheels 80, 82 are shown as contacting the belt at belt elements 95, 96 respectively which can be considered as the end elements of the rocker 53. As a consequence of the arc formed by rocker 53, these end elements will be spaced above the ground surface 56 so that the user's weight, applied to the belt inner surface 66, will place the hinged connections between elements in tension and the interfacing belt element surfaces outwardly thereof in compression.

Figure 5D:
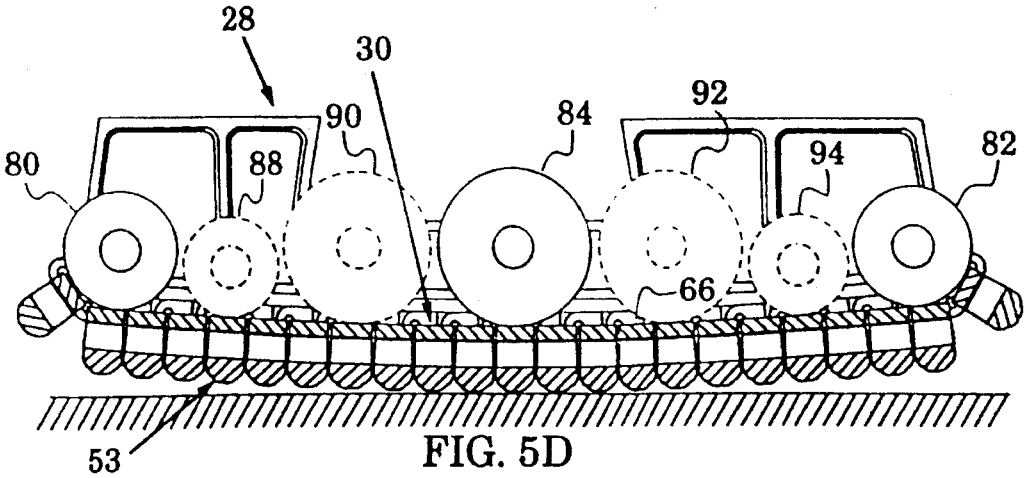
FIG. 5D shows the wheel and frame subassembly together with the belt in a loaded state.
Figure 6:
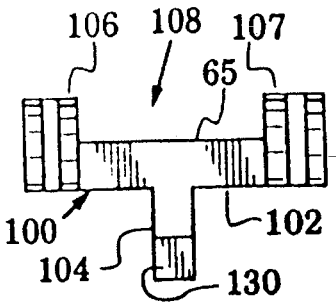
FIGS. 6,7,8,9 respectively show front, side, rear, and top plan views of a double-Y shaped link in accordance with the invention.

FIG. 5D schematically depicts the user's weight loaded onto the belt 30. That is, the user's weight, applied downwardly to the frame and wheel subassembly 28, will initially load the belt 30 via the end wheels 80, 82 to cause the belt to flatten slightly (contrast FIGS. 5C and 5D) causing the spanned inner surface of the belt to move into engagement with center wheel 84 and optional wheels 88, 90, 92, 94. As the belt is loaded by the user's weight, the belt's radius of curvature is forced slightly beyond its nominal value, thereby increasing tension in the interconnections between elements proximate to the belt inner surface and increasing compression between the elements interfacing surfaces proximate to the belt outer surface, to further rigidify or stiffen the rocker 53. Although it has been assumed that the belt 30 is able to straighten slightly (i.e., from FIGS. 5C to 5D) when loaded due to a small amount of inherent elasticity or slack (attributable, e.g., to part tolerances, wear, material distortion, etc.), this elasticity is not essential to the invention. That is, an essentially perfect belt having no elasticity could theoretically be utilized in which case the values of $R_i$ and $R_w$ would be essentially equal. However, it has been observed that a small amount of belt elasticity provides the benefit of slightly improving a user's ride because the belt is able to absorb small amounts of shock energy.

It will be recalled that each belt element 60 in the embodiment of FIGS. 1–3 has been assumed to comprise a link 62 and tire piece 63. Attention is now directed to FIGS. 6–9 which illustrate a preferred link 62 in greater detail. Link 62 is preferably integrally formed of a strong rigid material such as steel or an appropriate plastic. The link is shaped to define a laterally oriented cross member 100 having an upper flat floor surface 65 and a lower flat surface 102. A mounting stud 104 depends from the lower flat surface 102. Side flanges 106, 107 extend upwardly from the surface 65 at opposite sides thereof thus defining a channel 108 for accommodating an idler wheel 42 as depicted in FIG. 3B. The flange 106 is bifurcated at its forward end by slot 109 to form spaced hinge support arms 110, 112. Flange 107 is similarly bifurcated by slot 114 to form support arms 116, 118. Aligned pin openings 120 extend through the support arms 110, 112, 116, 118. Each flange 106, 107 terminates at its rear end in a projecting arm 122, 124. The arms 122, 124 define aligned pin openings 126. Because the link 62 is comprised of two bifurcated flanges 106, 107, it may sometimes be referred to as a double-Y type link.

Figure 10:
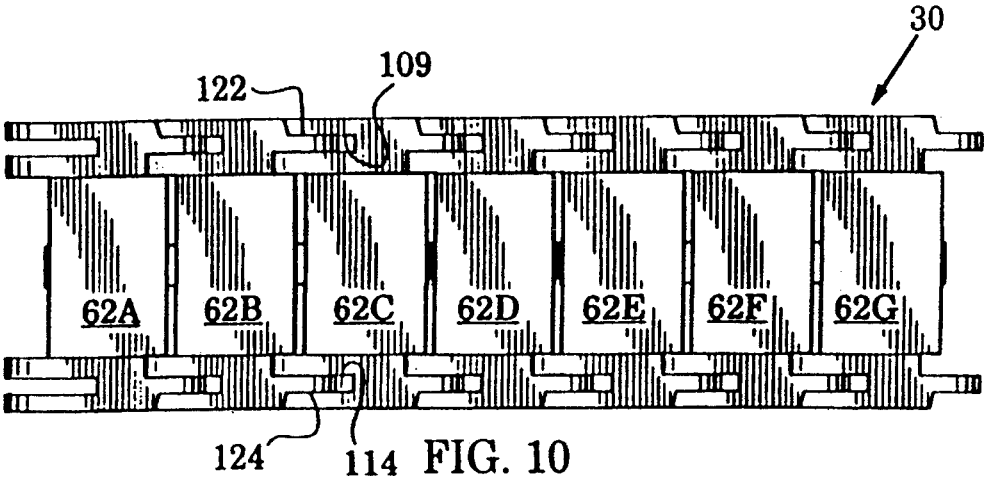
FIG. 10 is a top plan view showing several of the links of FIGS. 6–9 connected together.
Figure 11:
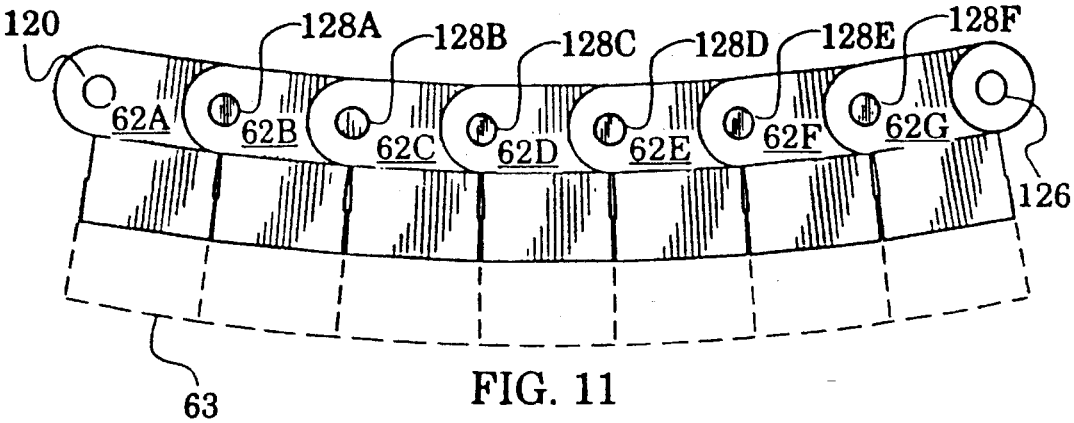
FIG. 11 shows a side plan view of FIG. 10.

When a plurality of links 62 are assembled to form a belt 30 (e.g., links 62A, 62B, 62C, 62D, 62E, 62F, 62G, as shown in FIGS. 10, 11), the arms 122, 124 of each link will extend into the slots 109, 114 of the trailing link so as to align pin openings 120 and 126. Hinge pins 128A, 128B, 128C, 128D, 128E, 128F (FIG. 11) extend through the aligned pin openings 120, 126 of flanges 106 longitudinally spaced along the belt. Aligned pin openings of flanges 107 similarly receive hinge pins (not shown). The pins are preferably press fit in the pin openings 120 and slip fit in the openings 126. The interfitting configuration of the arms 122, 124 extending into slots 109, 114 assures lateral belt rigidity while allowing the links to pivot relative to one another about hinge axes defined by pins 128. Note that the end face of support arm 110 is preferably radiussed and mates with a similarly configured recess 129 adjacent arm 122 to facilitate relative pivotal movement. The other arms are similarly configured.

Figure 7:
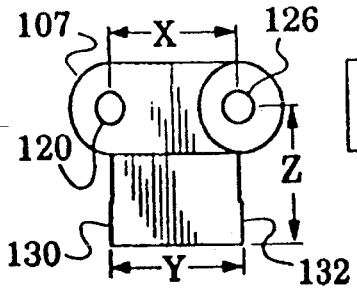
Figure 8:
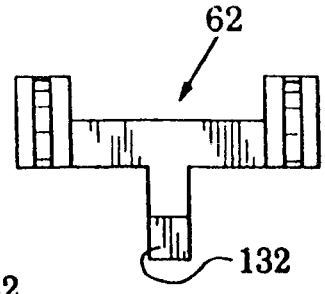
Figure 9:
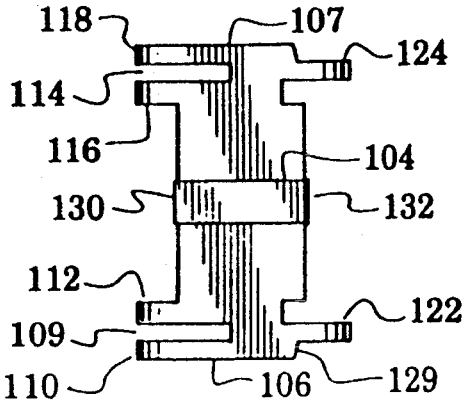

Each belt element 60 essentially defines a wedge shaped arc segment comprising a longitudinal dimension X between successive hinge axes proximate to its inner surface and a longitudinal dimension Y (where Y>X) spaced outwardly from the inner surface (See FIG. 7). This dimension Y is between interference surfaces 130, 132 formed on mounting stud 104. As a consequence of Y being greater than X, the surfaces 130, 132 of adjacent links interfere with each other thereby limiting the hinged movement of adjacent elements to an interior angle less than 180°, as discussed in connection with FIGS. 4B and 4C. By so limiting hinged movement, a series of such elements will form tim aforementioned rocker 53 having the arcuate outer surface 68. When the belt is loaded by the user's weight, the interference surfaces 130, 132 on adjacent links 62 will be put further into compression as the links are forced together to rigidify said rocker 53. Selected exemplary dimensions for the prototype link 62 shown in FIGS. 6–9 are as follows:

X=0.374 inches

Y=0.376 inches

Z=0.375 inches

The foregoing dimensions, together with a tire piece 63 adding about 0.125 inches (FIG. 11) yields the previously mentioned large radii of curvature, e.g., $R_i$ equal to approximately 56.0 inches and $R_o$ equal to approximately 56.5 inches.

Each of the idler wheels 80, 82, 84, 88, 90, 92, 94 is mounted for rotation on its own axle 40 secured between frame members 34, 36. The wheels are preferably mounted (as shown in FIG. 3B) similarly to wheels used on modern day in-line skates in that they utilize anti-friction ball bearing subassemblies 150, 152. The subassemblies, 150, 152 are respectively mounted on opposed spacers 154A, 154B carried by axle 40. Each wheel 42 defines recesses 156, 158 which respectively receive bearing subassemblies 150, 152. The wheels freely turn on the bearings 150, 152.

The belt 30 is mounted around wheels 80, 82, 84, 88, 90, 92, 94 with the belt upper loop portion 48 engaging and being supported by the wheels. With this configuration, the belt 30 is able to roll very smoothly and with little friction along its closed loop path.

Exemplary dimensions for the various wheels of the aforementioned prototype embodiment are as follows:

Outer diameter of wheels 80, 82=1.510 inches

Outer diameter of wheel 84=2.009 inches

Outer diameter of wheel 90, 92=1.930 inches

Outer diameter of wheels 88, 94=1.285 inches

Longitudinal spacing between wheels 80, 82=10.450 inches

The tire pieces 63 are preferably formed of an appropriate plastic material such as that typically used on commercially available in-line skate wheels, e.g., polyurethane. Although the tire pieces 63 are illustrated (FIG. 4) as being detachably secured by screws 64 to links 62, it is recognized that the links and tire pieces could alternatively be secured by an appropriate adhesive or be integrally formed. It is also pointed out that the shape of the tire pieces 63 could be varied to optimize skate performance and/or facilitate part production. Note, for example, that FIG. 1 shows the tire pieces as having a substantially rectangular lateral profile which provides maximum bearing surface continuity. However, FIGS. 5A, 5B, and 5D show that the tire pieces 63 could alternatively have a substantially U-shaped lateral profile 46.

Although FIGS. 6–9 show the interfering surfaces 130, 132 formed on the mounting stud 104, it is pointed out that alternatively, the tire pieces 63 could be dimensioned to define the interfering surfaces for limiting the hinge movement between adjacent elements to form the rocker. Further, the interfering surfaces 130, 132 are shown for clarity as being formed on discrete projections on the mounting stud 104. However, these discrete projections are not necessary and the full leading and trailing faces of the mounting stud could be tapered outwardly to define the dimension Y.

It is recognized or course that the belt 30 can be constructed in various alternative manners in accordance with the invention. Attention is now directed to FIGS. 12–15 which illustrate one such alternative belt embodiment 160. The belt 160 is functionally similar to the previously discussed belt 30 but differs therefrom in its structural implementation. More particularly, the belt 160 is comprised of a plurality of elements 164, each element including a link member 166 and a tire piece 168. The link 166 is T-shaped in cross section defining a laterally directed cross member 170 and a centrally positioned vertically oriented stem 172. The cross member 170 defines laterally oriented shelf surfaces 174, 176 located on opposite sides of the stem 172. The cross member 170 also defines a laterally oriented lower surface 180 to which the tire piece 168 is attached. Parenthetically, it is pointed out that although the link 166 and tire piece 168 have been shown as separate pieces which can be secured together by a suitable fastener or adhesive (not shown), it is also recognized that they can be integrally formed.

Figure 12:
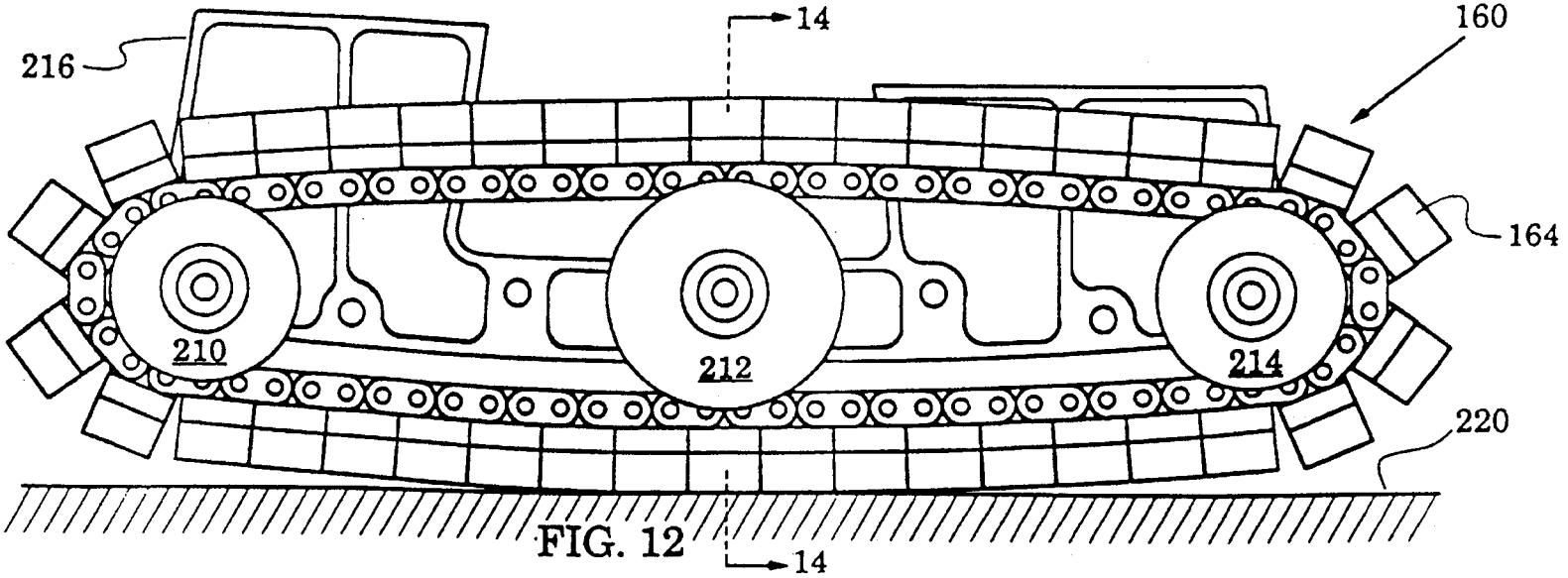
FIG. 12 is side schematic illustration of an alternative roller assembly in accordance with the invention.
Figure 13:
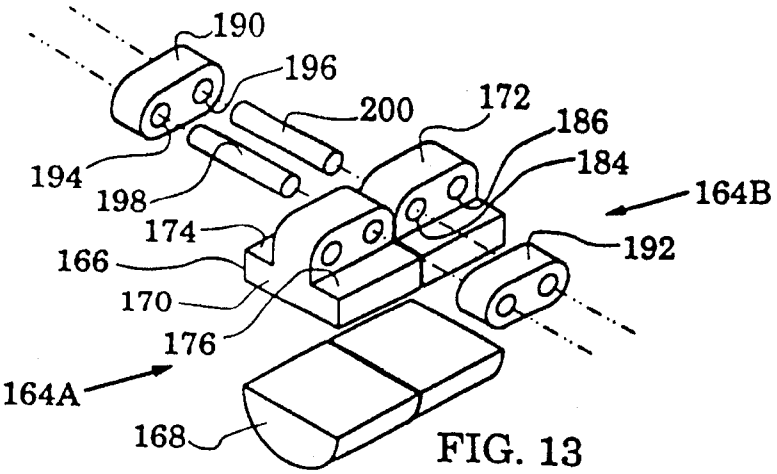
FIG. 13 is an isometric view of a pair of alternative belt elements used in the roller assembly of FIG. 12.

FIG. 13 depicts two adjacent belt elements 164, i.e., 164A, 164B. Note that the stem of each element defines a pair of spaced laterally oriented holes 184, 186. Adjacent elements 164 are strapped together for relative hinged movement utilizing side straps 190, 192. Note that each strap 190, 192 defines a pair of holes 194, 196 spaced to align with holes 184, 186 of adjacent elements. Hinge pins 198, 200 are provided for connecting the straps 190, 192 to adjacent elements. More particularly, note in FIG. 13 that hinge pin 198 extends through hole 186 of element 164A and is terminally accommodated in holes 194 of straps 190 and 192. Hinge pin 200 extends through hole 184 of adjacent element 164B and is terminally accommodated in holes 196 of straps 190, 192. With a plurality of elements 164 linked together by the hinge pins and straps as represented in FIG. 12, the belt elements can form an endless loop extending around idler wheels 210, 212, 214 mounted on frame 216. Note in FIG. 14 that the idler wheels define a peripheral channel 220 dimensioned to accommodate the lateral width of the stem 172 and side straps 190, 192. Consistent with the aforediscussed embodiments, the idler wheels 210, 212, and 214 are mounted for rotation about aligned axles. Note also that the end wheels 210 and 214 have smaller diameters than the center idler wheel 212 to form an arcuate path for engaging the belt inner surface along both its upper and lower portions. The idler wheels 210, 212, 214 function as load transfer members to transfer the user's weight to the belt inner surface.

Figure 15:
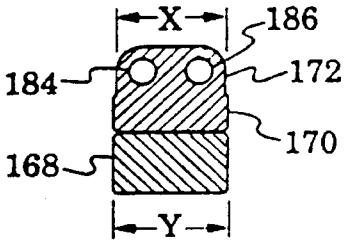
FIG. 15 is a sectional view taken substantially along the plane 15—15 of FIG. 14.
Figure 14:
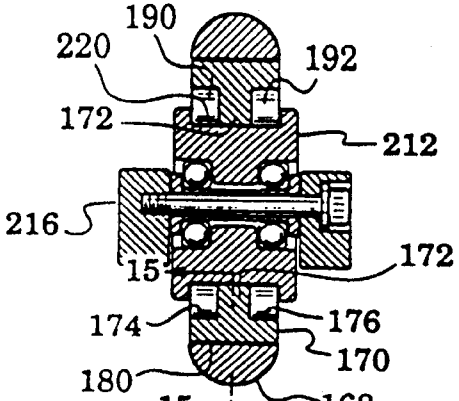
FIG. 14 is a sectional view taken substantially along the plane 14—14 of FIG. 12.

Similarly to the belt represented in FIG. 5A, the belt elements 164 are dimensioned to force the belt 160 to form a rigid rocker in its lower loop portion. This is preferably accomplished as shown in FIG. 15 by designing the cross member 170 with a longitudinal dimension Y slightly greater than the longitudinal dimension X of the stem 172. This dimensional difference will force each of the links 166 to pivot slightly relative to its adjacent link (i.e., the interior hinge angle is less than 180°) about hinge pins 198, 200 to thus cause the belt lower loop portion, as shown in FIG. 12, to form an upwardly opening arc. Although the larger longitudinal dimension Y for forcing the belt to define an arc has been shown as being defined by the cross member 170, alternatively, the dimension Y can be defined by tire piece 168.

Figure 16:
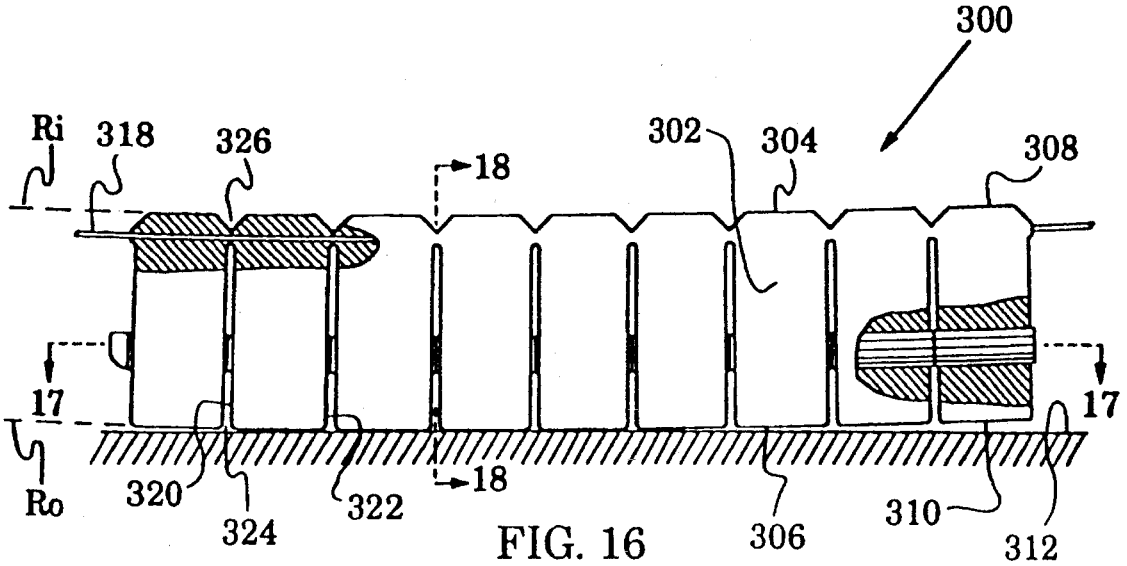
FIG. 16 is a side schematic illustration, partially broken away showing a portion of a further alternative belt constructed in accordance with the present invention.
Figure 17:
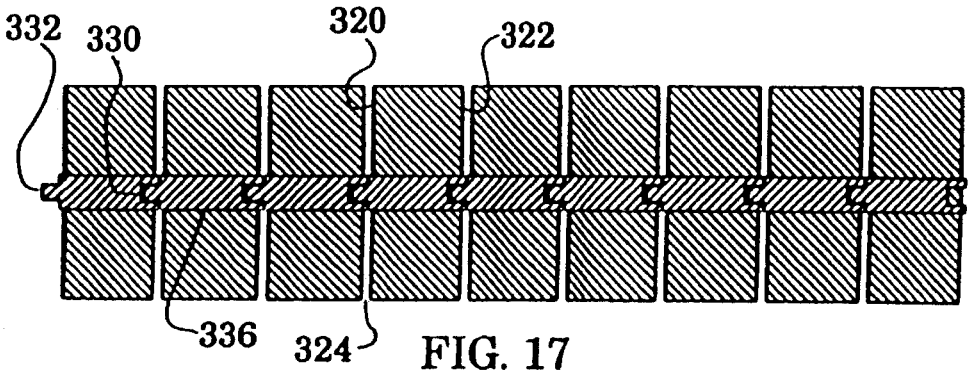
FIG. 17 is a sectional view taken substantially along the plane 17—17 of FIG. 16.
Figure 18:
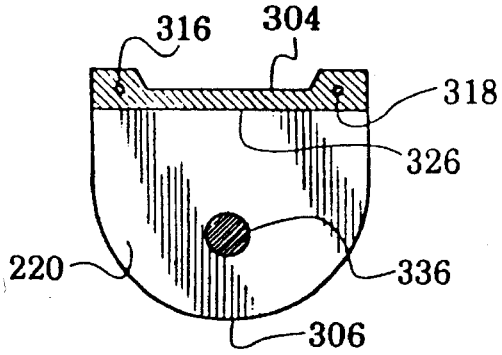
FIG. 18 is a section view taken substantially along the plane 18—18 of FIG. 16.

Attention is now directed to FIG. 16–19 which illustrate a still further belt embodiment 300 in accordance with the invention. Whereas the aforediscussed belts 30 and 160 were assembled from individual elements, it is proposed that the belt 300 be integrally molded of an appropriate plastic. More particularly, the belt 300 is comprised of a plurality of longitudinally aligned elements or sections 302, each having an upper surface 304 and a lower surface 306. The surfaces 304 collectively define a belt inner surface 308 for moving around a plurality of idler wheels in the aforedescribed manner. The surfaces 306 collectivity define an arcuate outer bearing surface 310 for engaging a supporting ground surface 312. FIG. 16 shows the sections 302 molded around and fixed to a flexible endless loop core formed, for example, by a pair of tension members or wires 316, 318 or a band (not shown).

Each element 302 defines longitudinally spaced laterally oriented faces 320, 322 which extend from the lower outer surface 306 toward the upper inner surface 304. The laterally oriented faces of adjacent elements are spaced from one another by slots 324, each of which is closed at its upper end by a small strap of material 326 which is preferably formed integral with the adjacent elements 302 to bridge the slot 324 therebetween. The bridging material 326 is dimensioned to act as a laterally oriented hinge enabling each element to pivot relative to an adjacent element.

Polyurethane timing belts incorporating steel or kevlar tension members are commercially available under the trademark BRECOFLEX. Such belts can be provided with outwardly projecting "weld-ons" of a variety of profiles. It is believed that the manufacturing process for such belts would be suitable to fabricate belts in accordance with the present invention, in which appropriately shaped and dimensioned "weld-ons", with or without hard inserts, could define the interference surfaces for limiting hinged motion to form the desired rocker.

In order to form a rigid rocker in the belt 300, each element 302 defines longitudinally spaced interference surfaces 330, 332 positioned outwardly of the hinge straps 326 to force the elements 302 to define a concave arc as shown in FIG. 16 where $R_i$ and $R_o$ respectively represent the large, but finite, radii of curvature of inner and outer belt surfaces 308,310. In the embodiment depicted in FIGS. 16–19A, element 302 is preferably formed of a plastic material molded around a steel or hard plastic spacer member 336 which defines interference surfaces 330, 332. In order to enhance the lateral rigidity of the belt, the spacer member 336 is preferably configured to define a rear slot 338 dimensioned to closely accommodate a forward projection 340. Although the interference surfaces 330, 332 are depicted as contacting one another close to the slot between adjacent belt elements 302, it is recognized that the members 336 could be configured so that the contact point is further recessed into the elements 302 to reduce contact noise.

In use, when the belt 300 is loaded by a frame and idler wheel subassembly, for example of the type previously discussed, the wires 316, 318 will be placed in tension and the interfering surfaces 330,332 will be placed in compression. The engaging interfering surfaces of adjacent elements will space the elements 302 by a greater longitudinal distance proximate to outer surface 310 than inner surface 308 adjacent hinge straps 326. As a consequence, the belt 300 will be forced into the rigid arcuate shape depicted in FIG. 16 for supporting a user's weight, as has been previously described.

Figure 19A:
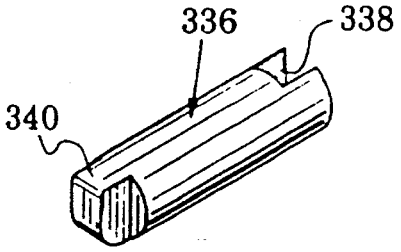
FIG. 19A is an isometric view of a spacer member used in the belt of FIG. 16.
Figure 19B:
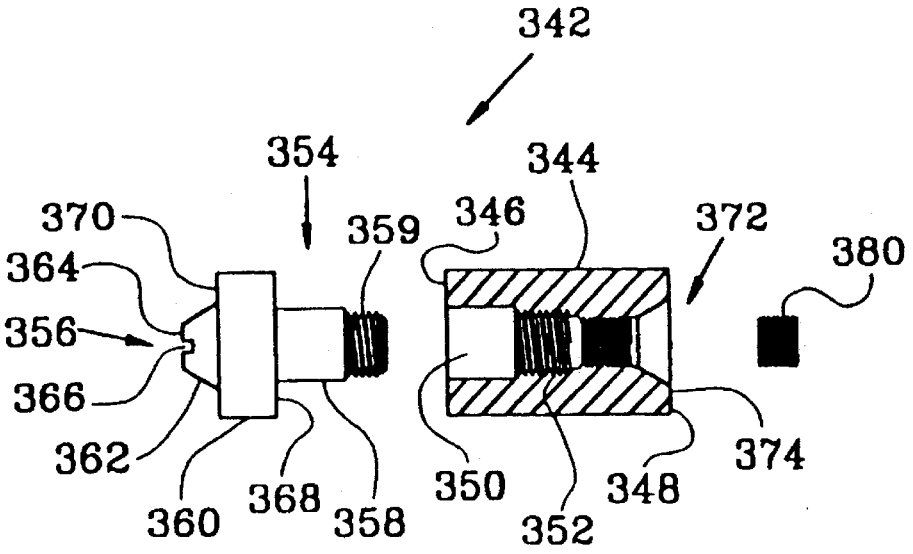
FIG. 19B is a side sectional view of an alternative spacer member.

Attention is now directed to FIG. 19B which depicts a spacer member 342, which can be used in place of space member 336, configured so that the longitudinal spacing between interference surfaces can be adjusted. By adjusting this spacing, a user can establish a desired radius of curvature of the rocker to achieve a preferred "feel". Although, the adjustable spacer 342 is being introduced herein in association with molded belt 300 of FIGS. 16–18, it should be understood that the same or similar adjustment technique can also be incorporated in other belt embodiments.

The spacer member 342 (FIG. 19B) is comprised of a rigid body member 344 having a front face 346 and rear face 348. A cylindrical bore 350 extends into the body member 344 from the front face 346 and includes a threaded portion 352. An adjustable member 354 includes a nose portion 356 and shaft portion 358. The shaft portion 358 is externally threaded at 359 for engagement with threaded bore portion 352. The nose portion 356 includes a collar 360 and a forwardly extending conical projection 362. The end face 364 of the projection 362 is slotted at 366 for receiving a screwdriver blade to facilitate adjustment. The collar 360 defines a rear surface 368 and a front surface 370 which functions as an interference surface for engaging a spacer member 342 in an adjacent belt element. More particularly, body member 344 defines a rear pocket 372 extending axially from a rear surface 374. The rear pocket 372 is internally shaped and dimensioned to closely accommodate the conical projection 362 and permit front surface 370 to engage rear surface 374 of an adjacent element. A set screw 380 can be inserted through a small threaded passage accessible through rear pocket 372 to hold the adjustable member 354 in its selected longitudinal position. By selectively threading member 354 into body member 344, a user will be able to adjust the spacing between interference surfaces 370 and 374, typically within a range of about 0.010 inch, to thus vary the rocker arc. Although a user might choose to adjust every belt element, it is pointed out that a satisfactorily configured rocker could be formed if, a lesser number, for example every second or third element, were adjusted.

Figure 20:
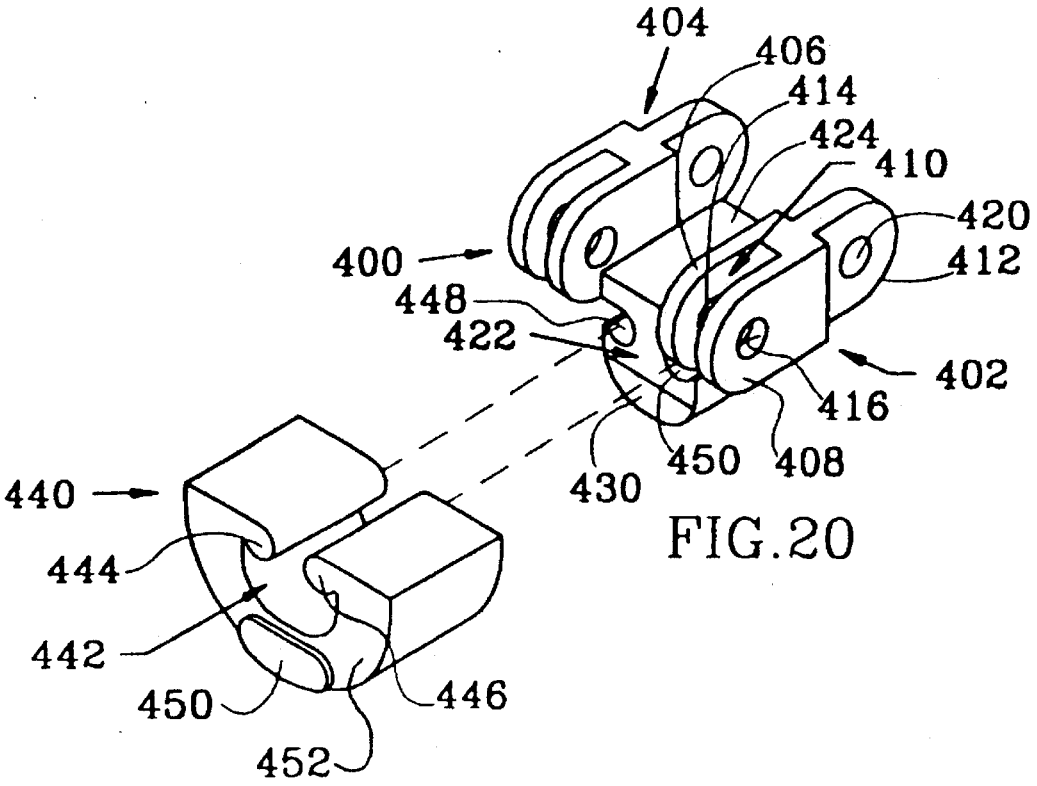
FIG. 20 is an isometric view of a modified double-Y shaped link and a mating molded tire piece.
Figure 21A:
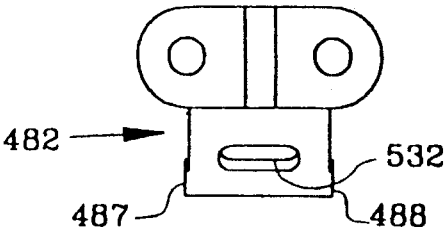
FIGS. 21A and B respectively show a side elevation and an isometric view of a further modified double-Y link which can be fabricated from a stamped and formed metal part.
Figure 21B:
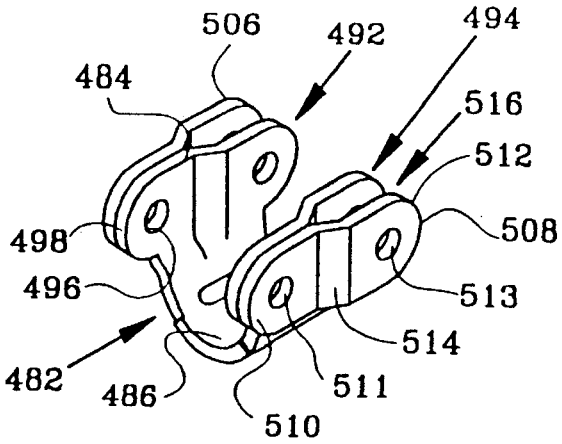
FIG. 21C is an isometric view of a belt element comprised of the link of FIGS. 21A,21B and having a floor piece and tire piece molded therein.

Attention is now directed to FIG. 20 which illustrates an alternative double-Y shaped type link 400 analogous to the link 62 depicted in FIGS. 6–9. The link 400 is comprised of first and second Y-shaped members 402, 404. Each member 402, 404 defines bifurcated support arms 406, 408 extending from one end and defining a slot 410 therebetween. A projecting arm 412 extends from the other end for being accommodated for hinged movement in the slot 410 of a succeeding link. Pin openings 414, 416 are respectively formed in arms 406, 408 for receiving a press-fit hinge pin (not shown). The pin is intended to pass through a slip-fit opening 420 in the arm 412 of an adjacent link. The Y-shaped members 402, 404 are formed integral with, or secured to, a central body member 422. The body member 422 defines a floor surface 424 for a wheel channel extending between members 402, 404. The body member 422 defines an essentially wedge shaped profile having a front laterally oriented interference surfaces 430 and a rear interference surface (not shown) longitudinally spaced by a distance Y where Y is greater than the distance X between openings 416 and 420. By being so configured, a plurality of links connected in series will form a concave/convex rocker as previously described and shown, e.g., FIG. 11.

FIG. 20 further shows a tire piece 440 having a central recess 442 shaped and dimensioned to accommodate the lateral profile of body member 422. The tire piece 440 includes two inwardly projecting arms 444, 446 shaped and dimensioned to snugly slide in passages 448, 450 extending longitudinally through body member 422 to mount the tire piece 440 on the link 400.

Depending upon the intended application and the tension and compression forces contemplated, the link 400 can be formed of steel or other appropriate metal or composite by traditional techniques such as machining, casting, molding, powder metal forming, etc. The tire piece 440 is preferably formed of polyurethane and can either be removably mounted on the link as suggested by FIG. 20, or directly molded thereon. Although it is contemplated that the primary interference surfaces for forming the rocker will generally be provided by the link 400, as at 430, 431, it is recognized that sole or supplemental interference could be provided by pad 450 formed on the end face 452 of tire piece 440. Even if the harder material typically used for the link 400 provides the main rocker forming interference, nevertheless a pad of softer material 450 can be advantageously used to soften the impact between interference surfaces.

Attention is now directed to FIGS. 21A, 21B, 21C and 22 which illustrate a low cost alternative double-Y element 480 including a link 482 configured of one or more metal stampings. More particularly, the link 482 is comprised of a central stamping 484 bent to define a U-shape including an arcuate cross member 486 defining interference surfaces 487, 488. Legs 489, 490 extend upwardly from cross member 486 and terminate at their upper ends in longitudinally oriented tension members 492, 494. The members 492, 494 define a slip-fit pin opening 496 at a forward end 498 and a press-fit pin opening 500 at a rear end 502. The members 492, 494 each contain a joggle 504 so that rear ends 502 are laterally spaced more closely than forward ends 498. Longitudinally oriented tension members 506, 508 which may be stamped independently or together with central stamping 484, are respectively mounted adjacent members 492, 494. Members 506, 508 each contain a forward end 510 containing a slip-fit opening 511 and a rear end 512 containing a press-fit opening 513. The members 506, 508 each contain a joggle 514 so that rear ends 512 are laterally spaced further apart than forward ends 510. As a consequence of the inward joggles 504 formed in inner members 492, 494 and the outward joggles 514 formed in outer members 506, 508, the forward ends 498 and 510 can be brought into contiguous contacting relationship whereas the rear ends 502 and 512 will be spaced by a slot 516. The joggles 504, 514 are designed so that the slot 516 receives the forward ends 498, 510 of an adjacent element for hinged movement about hinge pins (not shown).

Figure 22:
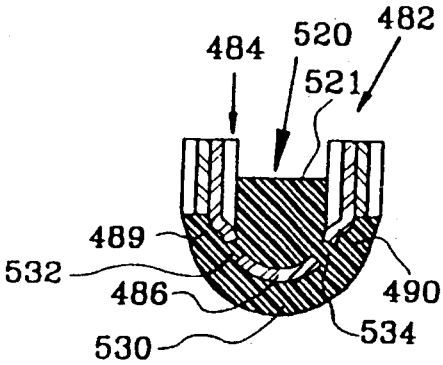
FIG. 22 is a sectional view taken substantially along the plane 22—22 of FIG. 21 C.
Figure 21C:
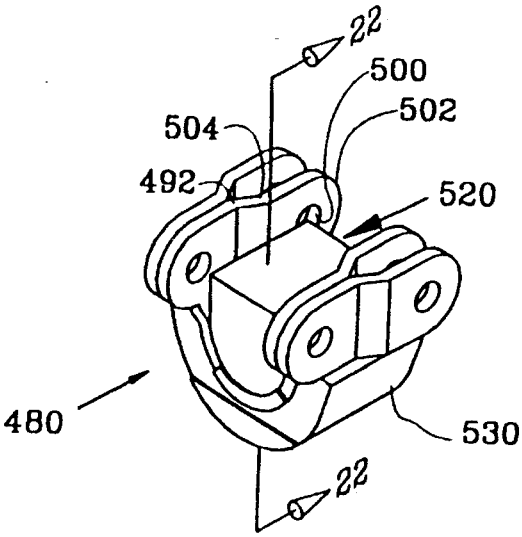

A floor member 520 is accommodated between tension members 492, 494 above cross member 486. Floor member 520 defines a flat floor surface 521 positioned to be engaged by load transfer members such as idler wheels 42 of a frame and wheel subassembly, e.g., subassembly 28 shown in FIGS. 5B–5D. A tire piece 530 is mounted around and beneath cross member 486, as depicted in FIG. 22. The floor member 520 and tire piece 530 can be integrally molded around the cross member 486, extending through openings 532, 534 formed therein. Alternatively, the floor member 520 and tire piece 530 can be separately molded and fitted together by interlocking portions.

Attention is now directed to FIGS. 23–27 which illustrate a still further belt embodiment 538 comprised of elements 540 characterized by a single Y shape. Each element 540 defines a forwardly projecting portion 542 and laterally spaced rearwardly extending arms 544, 546 defining a slot 547 therebetween. Aligned lateral openings 548, 550 dimensioned to receive a press fit hinge pin 551, are respectively formed in arms 544, 546. Opening 552 dimensioned to receive a hinge pin 551 for a slip fit, is formed in projecting portion 542. A series of elements 540, each having its projecting portion 542 extending into a slot 547 between arms 544, 546 of an adjacent element, can be interconnected by hinge pins 551 to form an endless belt 552 as shown in FIGS. 26, 27.

Element 540 includes an integral depending block 554 which defines front and rear interference surfaces 556, 558 longitudinally spaced by a distance Y which is greater than the longitudinal distance X between openings 552 and 550. As a consequence, a series of elements 540 will form a rocker 559 (FIG. 27) having a concave inner surface 560 and convex outer surface 561. The block 554 preferably has a lateral profile (FIG. 25) defining passages 562, 564 for mounting a tire piece 566.

FIG. 25 shows a lateral cross section taken through an element 540 depicting how the belt inner surface 560, collectively formed by the flat upper surfaces 568 of elements 540, is engaged by an idler wheel 570. Note that idler wheel 570 (FIG. 25) is similar to idler wheel 212 (FIG. 14) in that it defines a peripheral channel 572 dimensioned to accommodate the lateral width of belt elements 540. The wheel 570 is formed of relatively hard material to assure good belt guidance and low friction in the channel 572. However, the central periphery of the channel 572 which contacts the belt is preferably formed of a softer somewhat more compliant material 578. The increased compliance of the central periphery material 578 facilitates a smooth transition of the belt around the path defined by the idler wheels. It should be understood that the utilization of such a compliant material 578 for contacting the belt is appropriate, particularly for the end wheels, for all of the embodiments disclosed herein, regardless of whether the channel is formed in the wheels or the belt.

Attention is now directed to FIGS. 28, 29, 30A and 30B which illustrate a further embodiment including load transfer members comprised of idler wheels 700, 702, 704 and rigid members 706, 708. Members 706, 708 each define low friction slide surfaces 710, 712 which together with wheels 700, 702, 704 form an arcuate loading surface 714 having a radius of curvature $R_w$. The loading surface 714 is positioned adjacent the inner arcuate surface 716 of belt 718. The belt 718 is shown as being formed by elements 720, substantially identical to that shown in FIGS. 21 A–C and 22. The belt inner arcuate surface 716 is formed by floor members 722 and defines a nominal radius of curvature $R_i$ where $R_w$ is greater than $R_i$. The wheels 700, 702, 704 and rigid members 706, 708 are shown as projecting into channels 723 formed in the belt elements 720 to engage floor surfaces 724 of members 722. However, it should be understood that the channel could alternatively be formed in members 700, 702, 704, 706, 708 to accommodate the belt as was depicted in FIG. 14. In use, the slide surfaces 710, 712, as well as the floor surfaces 724 should be formed of low friction material to enable the floor surface to readily slide relative to members 706, 708.

Figure 30A:
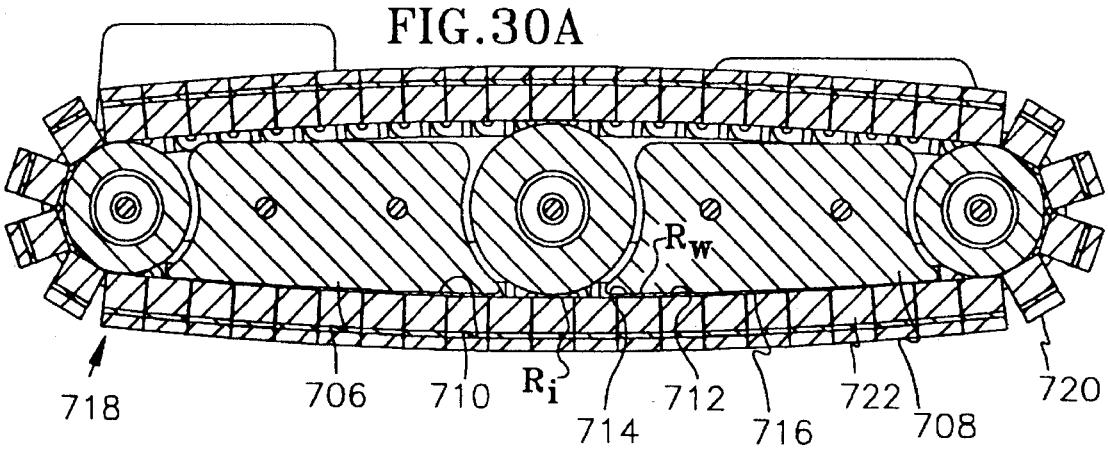
FIGS. 30A and 30B comprise longitudinal sectional views respectively depicting the belt of FIG. 28 in unloaded and loaded conditions.
Figure 30B:
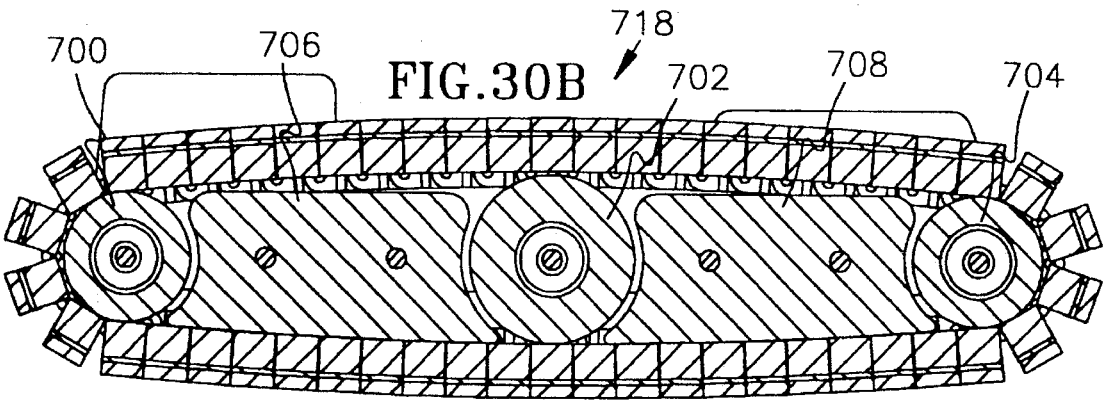

FIG. 30A depicts the belt 718 unloaded with a central portion of loading surface 714 slightly spaced from belt inner surface 716. FIG. 30B depicts the belt loaded by the user's weight with loading surface 714 fully contacting belt inner surface 716.

Figure 28:
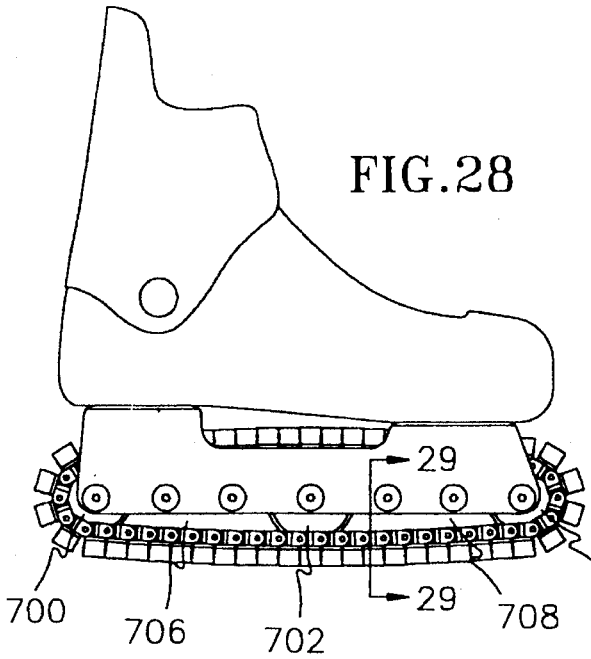
FIG. 28 is a side plan view of a further alternative embodiment of the invention using idler wheels and low fiction slide surfaces cooperatively to load the belt rocker.
Figure 29:
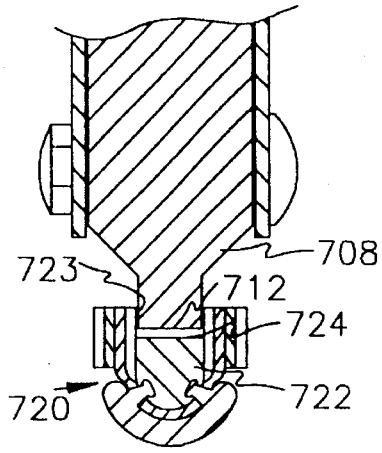
FIG. 29 is a sectional view taken substantially along the plane 29—29 of FIG. 28.

FIGS. 31, 32, 33A and 33B illustrate an embodiment similar to that shown in FIGS. 28–30 in which, instead of using idler wheels, the load transfer member comprises a single block 740 defining a loading surface 742 having a radius of curvature $R_w$. The surface 742 bears against the inner arcuate floor surface 744 of belt 746 having a nominal radius of curvature $R_i$, where $R_w$ is greater than $R_i$. The belt 746 is depicted as being substantially identical to belt 718 of FIGS. 30A, 30B except that the floor members 748 are depicted as being joined by a continuous web, such as a polyurethane timing belt, defining a continuous floor surface 744. The surface 742 and floor surface 744 are formed of low friction material able to slide relative to one another. Additionally, however, it is contemplated that the block 740 define an internal reservoir 750 to accommodate an appropriate lubricant which can be dispensed into the interface between the surfaces 742, 744 via bleed holes 752. The lubricant can be recirculated via capture openings 754.

From the foregoing, it should now be apparent that an improved skate roller assembly has been disclosed herein characterized by an endless loop belt configured to form a rigid rocker for supporting a user's weight. The rigid rocker defines a substantially continuous arcuate bearing surface for engaging and rolling along a ground surface to enable the skate to be easily maneuvered while permitting its large radius of curvature to readily roll over surface discontinuities.

Although only a limited number of structural embodiments has been disclosed herein, it is recognized that variations and modifications will readily occur to those skilled in the art to address particular cost parameters and users of different weight and skill levels. For example only, the belt elements can be variously configured, as with differently oriented and shaped interfering surfaces, e.g., nesting V-shapes. Moreover, the elements of each belt embodiment need not be all identical. For example, a belt embodiment comprised of differently configured elements could form the desired rocker so long as a group of successive elements engage to collectively form the rocker arc. As an example of a still further variation, each element could be configured for hinged movement about a single axis, rather than dual axes. In a still further variation, the limited hinged movement of the belt elements could be achieved proximate to the inner surface, as e.g., by specially shaping the hinge pins or the sleeves in which they turn. It is thus intended that the appended claims be interpreted to include a broad range of structures for performing in the manner disclosed.

I claim:

1. An elongate roller assembly configured for attachment to the underside of a boot foot plate to form a roller skate for enabling a user to roll along a ground surface, said assembly comprising:

an elongate belt forming an endless loop;

said belt comprising a plurality of longitudinally aligned elements, each connected for hinged movement relative to an adjacent element about a laterally directed hinge axis, said belt being mounted for movement of said elements along a defined path including a longitudinally extending lower loop portion;

at least some of said elements being configured to interfere with adjacent elements to limit said hinged movement for causing a group of successive elements to form a weight supporting rocker in the region of said lower loop portion, said rocker defining an inner concave surface and an outer convex surface for engaging said ground surface; and at least one load transfer member for loading a user's weight onto said inner concave surface to rigidify said rocker; and wherein said belt inner concave surface defines a radius of curvature $R_i$; and wherein said load transfer member defines a loading surface having a radius of curvature $R_w$ where $R_w$ is greater than $R_i$.

2. The assembly of claim 1 wherein $R_i$ and $R_w$ are both finite and exceed one foot.

3. The assembly of claim 1 wherein said load transfer member comprises an idler wheel for engaging said inner concave surface.

4. An undercarriage roller assembly suitable for mounting under a boot foot plate, said assembly including:

an elongate endless belt defining a longitudinal direction and a lateral direction;

said belt including a plurality of elements arranged in succession in said longitudinal direction, each of said elements being supported for hinged movement, about a laterally oriented hinge axis, with respect to the next element in said succession;

said belt defining an inner circumferential surface and an outer circumferential surface;

at least some of said elements being configured to restrict the range of said hinged movement to limit said belt inner surface to being concave and said belt outer surface to being convex, said belt inner surface defining a radius of curvature $R_i$;

means supporting said endless belt for movement around a close loop path; and means for connecting a boot foot plate to said belt to transfer a force applied thereto to said belt inner surface, said means for connecting including at least one load transfer member defining a loading surface for loading a user's weight onto said belt inner surface, said loading surface having a radius of curvature $R_w$ where $R_w$ is greater than $R_i$.

5. The assembly of claim 4 wherein said elements configured to restrict hinged movement include an interference surface located to engage an interference surface on an adjacent element for limiting the interior hinge angle therebetween to less than 180°.

6. An elongate roller assembly configured for attachment to the underside of a boot foot plate to form a roller skate for enabling a user to roll along a ground surface, said assembly comprising:

an elongate belt forming an endless loop;

said belt comprising a plurality of longitudinally aligned elements, each connected for hinged movement relative to an adjacent element about a laterally directed hinge axis, said belt being mounted for movement of said elements along a defined path including a longitudinally extending lower loop portion;

at least some of said elements being configured to interfere with adjacent elements to limit said hinged movement for causing a group of successive elements to form a weight supporting rocker in the region of said lower loop portion, said rocker defining an inner concave surface and an outer convex surface for engaging said ground surface; and at least one load transfer member for loading a user's weight onto said inner concave surface to rigidify said rocker;

said load transfer member defining a rigid loading surface for engaging said inner concave surface, said loading surface and said inner concave surface having low friction characteristics to enable relative sliding therebetween; and means for introducing a lubricant between said loading surface and said inner concave surface.

7. The assembly of claim 6 wherein said belt inner concave surface defines a radius of said loading surface has a radius of curvature $R_w$ where curvature $R_i$; and wherein said loading surface has a radius of curvature $R_w$ where $R_w$ is greater than $R_i$.

8. The assembly of claim 6 wherein said elements configured to limit hinged movement include an interference surface located to engage an interference surface on an adjacent element for limiting the interior hinge angle therebetween to less than 180°.

* * * * *